US009926102B2

(12) United States Patent
Baker et al.

(10) Patent No.: US 9,926,102 B2
(45) Date of Patent: Mar. 27, 2018

(54) SYSTEMS AND METHODS FOR PROVIDING A PACKAGED THERMOPLASTIC MATERIAL

(71) Applicants: Trent N. Baker, Grantsville, UT (US); Brent C. Maxwell, West Valley, UT (US)

(72) Inventors: Trent N. Baker, Grantsville, UT (US); Brent C. Maxwell, West Valley, UT (US)

(73) Assignee: Maxwell Properties, LLC, Salt Lake City, UT (US)

( * ) Notice: Subject to any disclaimer, the term of this patent is extended or adjusted under 35 U.S.C. 154(b) by 40 days.

(21) Appl. No.: 14/732,510

(22) Filed: Jun. 5, 2015

(65) Prior Publication Data

US 2016/0355296 A1 Dec. 8, 2016

Related U.S. Application Data

(60) Provisional application No. 62/008,383, filed on Jun. 5, 2014.

(51) Int. Cl.
*B65D 6/16* (2006.01)
*B65B 7/16* (2006.01)
(Continued)

(52) U.S. Cl.
CPC ..... *B65D 11/18* (2013.01); *B65B 7/16* (2013.01); *B65D 5/5405* (2013.01); *B65D 11/10* (2013.01);
(Continued)

(58) Field of Classification Search
CPC ..... B65D 11/18; B65D 11/10; B65D 25/14; B65D 25/30; B65B 7/16
(Continued)

(56) References Cited

U.S. PATENT DOCUMENTS 2,352,865 A 7/1944 Smith
2,359,679 A * 10/1944 Roehrl ..... B65D 5/422 206/389
(Continued)

FOREIGN PATENT DOCUMENTS

EP 0026430 A1 9/1980
EP 0270698 A1 12/1986
(Continued)

OTHER PUBLICATIONS

Ahmedzade et al., "Evaluation of Steel Slag Coarse Aggregate in Hot Mix Asphalt Concrete", Journal of Hazardous Material 165, 2009, pp. 300-305.
(Continued)

*Primary Examiner* — Anthony Stashick
*Assistant Examiner* — James Way
(74) *Attorney, Agent, or Firm* — David B. Tingey; Bryant J. Keller; Kirton McConkie

(57) ABSTRACT

The present invention relates to thermoplastic products and packaging therefor. More particularly, some implementations of the invention relate to a thermoplastic material that is packaged in a box, such as a corrugated cardboard box. In some cases, the box has a quick opening mechanism extending between two opposite sides of the box. Some examples of such quick opening mechanisms include a perforation, a tear strip, a hook-and-loop fastener, and a chain stitch. While the packaging can in opened in any suitable manner, in some cases, a user grabs a flap on the box, pulls the flap to rip the box down a perforated quick opening mechanism, and uses the weight of the thermoplastic material to knock down the box so that it becomes substantially flat. Other implementations are also described.

19 Claims, 8 Drawing Sheets

(51) Int. Cl.

| | |
|---|---|
| ***B65D 6/00*** | (2006.01) |
| ***B65D 25/14*** | (2006.01) |
| ***B65D 25/30*** | (2006.01) |
| ***B65D 5/54*** | (2006.01) |
| *B65D 5/02* | (2006.01) |
| *B65D 5/42* | (2006.01) |
| *B65D 5/60* | (2006.01) |

(52) U.S. Cl.
CPC ..... *B65D 25/14* (2013.01); *B65D 25/30* (2013.01); *B65D 5/029* (2013.01); *B65D 5/4283* (2013.01); *B65D 5/60* (2013.01)

(58) Field of Classification Search
USPC ..... 229/235
See application file for complete search history.

(56) References Cited

U.S. PATENT DOCUMENTS 2,862,616 A 7/1958 Capozzi et al.
2,862,612 A * 12/1958 Brown ..... B65D 73/02 206/338
3,360,182 A * 12/1967 Gunn ..... B65D 77/30 206/558
3,640,759 A 2/1972 Primus et al.
3,918,631 A * 11/1975 Hackenberg ..... B65D 5/0281 206/362
4,092,282 A 5/1978 Callan
4,190,156 A 2/1980 Adam
4,310,446 A 1/1982 Gaus et al.
4,334,615 A 6/1982 Butler et al.
4,443,578 A 4/1984 Frier
4,706,893 A 11/1987 Brock
4,818,367 A 4/1989 Winkler
4,971,218 A 11/1990 Buchner et al.
4,978,825 A 12/1990 Schmidt et al.
5,110,641 A 5/1992 Kean
5,160,686 A 11/1992 Thaler et al.
5,223,032 A 6/1993 Gaudio et al.
5,257,491 A 11/1993 Rouyer et al.
5,278,207 A 1/1994 Kluttz
5,322,867 A 6/1994 Kluttz
5,339,975 A 8/1994 Stoner
5,392,592 A 2/1995 Bozich et al.
5,397,530 A 3/1995 Narasimhan et al.
5,451,619 A 9/1995 Kluttz et al.
5,452,800 A 9/1995 Muir
5,494,510 A 2/1996 Kuc, Sr.
H1580 H 8/1996 Kluttz
5,543,211 A 8/1996 Gallagher et al.
5,576,363 A 11/1996 Gallagher et al.
5,624,594 A 4/1997 Matsen et al.
5,671,883 A * 9/1997 Philips ..... B65D 5/32 229/236
5,712,033 A 1/1998 Gallagher et al.
5,718,752 A 2/1998 Kluttz
5,723,844 A 3/1998 Dow et al.
5,733,616 A 3/1998 Janicki et al.
5,765,686 A 6/1998 Wright et al.
RE36,177 E 4/1999 Rouyer et al.
5,897,951 A 4/1999 Gallagher et al.
5,911,817 A 6/1999 Hayner
5,918,801 A * 7/1999 Milio ..... B65D 5/542 229/237
5,989,662 A 11/1999 Janicki et al.
5,992,628 A 11/1999 Vermilion et al.
6,067,776 A 5/2000 Heuer et al.
6,102,613 A 8/2000 Medico, Jr. et al.
6,107,373 A 8/2000 Janicki et al.
6,115,029 A 9/2000 Jaaskelainen, Jr. et al.
6,139,612 A 10/2000 Kitagawa et al.
6,206,607 B1 3/2001 Medico, Jr. et al.
6,230,890 B1 5/2001 Waver et al.
6,362,257 B1 3/2002 Chehovits et al.
6,405,921 B1 6/2002 Cochrane
6,457,637 B1 * 10/2002 Fritz ..... B65D 5/5445 206/736
6,604,677 B1 * 8/2003 Sutherland ..... B65D 71/36 206/427
6,755,306 B2 * 6/2004 Maus ..... B65D 5/5445 206/774
6,766,941 B1 7/2004 Tokarski
6,966,723 B2 11/2005 Zentner
6,981,632 B2 * 1/2006 Gardner ..... B65D 5/541 229/103.3
7,350,670 B2 4/2008 Steeves et al.
7,410,062 B2 8/2008 Monk
7,874,477 B2 * 1/2011 Sutherland ..... B65D 71/36 206/427
7,994,244 B2 8/2011 Binkley
8,017,681 B2 9/2011 Guymon et al.
8,162,059 B2 4/2012 Nguyen et al.
8,283,409 B2 10/2012 Guymon et al.
8,459,538 B2 6/2013 Raeth et al.
8,952,089 B2 2/2015 Guymon et al.
2001/0020058 A1 9/2001 Kamaishi et al.
2003/0032707 A1 2/2003 Hemmings et al.
2003/0091389 A1 5/2003 Zentner
2003/0155261 A1 8/2003 Paul et al.
2003/0190438 A1 10/2003 Suzuki et al.
2006/0058461 A1 3/2006 Krulis et al.
2006/0292356 A1 12/2006 Minagoshi
2007/0027235 A1 2/2007 Marchal
2007/0231545 A1 10/2007 Ruan
2008/0118689 A1 5/2008 Mehta et al.
2008/0190326 A1 8/2008 Fields
2009/0084287 A1 4/2009 Partanen et al.
2010/0210745 A1 8/2010 McDaniel et al.
2011/0121222 A1 5/2011 Guymon et al.
2011/0168058 A1 7/2011 Forth
2011/0272858 A1 11/2011 Tamir
2011/0294927 A1 12/2011 Williams et al.
2013/0075298 A1 3/2013 Chehovits et al.
2013/0104774 A1 5/2013 Teeter, Jr. et al.
2013/0199410 A1 8/2013 Maldonado et al.
2013/0273272 A1 10/2013 Guymon et al.
2014/0263283 A1 9/2014 Maxwell et al.
2015/0018460 A1 1/2015 Guymon et al.
2015/0191283 A1 7/2015 Guymon et al.

FOREIGN PATENT DOCUMENTS

EP 0270698 B1 12/1986
EP 0637548 A1 8/1993
EP 2383193 B1 11/2012
WO WO 1991/18803 A1 12/1991
WO WO 1999/30973 A1 6/1999
WO WO 2000/55280 A1 9/2000
WO WO 2000/76856 A1 12/2000
WO WO 2003/066452 A2 8/2003
WO WO 2004/096917 A1 11/2004
WO WO 2007/124237 A1 11/2007

OTHER PUBLICATIONS

Tapkin, "Mechanical Evaluation of Asphalt-Aggregate Mixtures Prepared with Fly Ash as a Filler Replacement", Can. J. Civ. Eng 35, 2008, pp. 27-40.
Tore et al., "Mechanical and Morphological Studies of Poly(propylene)-Filled Eggshell Composites", Macromolecular Materials and Engineering 292, 2007, pp. 1027-1034.

* cited by examiner

SYSTEMS AND METHODS FOR PROVIDING A PACKAGED THERMOPLASTIC MATERIAL

RELATED APPLICATIONS

This application claims priority to U.S. Provisional Patent Application Ser. No. 62/008,383, entitled "SYSTEMS AND METHODS FOR PROVIDING A PACKAGED THERMOPLASTIC MATERIAL", which was filed on Jun. 5, 2014 and which is incorporated herein in its entirety by reference.

BACKGROUND OF THE INVENTION

Field of the Invention

The present invention relates to thermoplastic materials and packaging therefor. In particular, some implementations of the present invention relate to systems and methods for packaging a thermoplastic material in a container having a quick opening mechanism that allows the container to easily be removed from the thermoplastic material and that allows the container to easily be knocked down or flattened.

Background and Related Art

Thermoplastics typically include one or more polymers that change to a liquid or semi-liquid state when the polymers are heated sufficiently, and that freeze or solidify to a rigid or semi-rigid state when the polymers are cooled sufficiently. While thermoplastics have a wide variety of uses, in some cases, such materials are used as pavement joint sealants, pavement crack sealants, waterproofing membranes, hot-melt adhesives, roofing asphalt, paving grade asphalt cement, and a variety of other products. In many such cases, thermoplastics (e.g., thermoplastic sealants, waterproofing membranes, hot melt adhesives, etc.) are heated, mixed, and then applied to a surface (e.g., pavement, a roof, etc.), where they are allowed to cool and harden.

When thermoplastics are used as sealants, membranes, adhesives, and/or in a similar manner, they are often used to minimize water infiltration, prevent the accumulation of debris, prolong the life of, and otherwise protect the material or structure to which they are applied. In this regard, some examples of materials that can be protected by thermoplastics (such as thermoplastic sealants) include, but are not limited to, asphalt pavement and Portland cement pavement. Moreover, some non-limiting examples of structures that can be protected by thermoplastics include roads, roofs, bridge decks, retention ponds, sidewalks, parking lots, tarmacs, and a wide variety of other structures.

As some thermoplastic materials can be relatively sticky, even in their solid or semi-solid form, such thermoplastics are often packaged until use. Although, such thermoplastics can be packaged in a variety of ways, some methods for packaging thermoplastic materials have shortcomings. Indeed, in some techniques for packaging thermoplastics, the packaging can be relatively expensive, can be relatively hard to compact, can undesirably tear into small pieces that make a mess, can require the use of knives or other sharp and potentially dangerous instruments to open such packaging, and can otherwise be difficult to use.

Thus, while techniques currently exist that are used to package thermoplastic materials, challenges still exist, including those discussed above. Accordingly, it would be an improvement in the art to augment or even replace current techniques with other techniques.

SUMMARY OF THE INVENTION

The present invention relates to thermoplastic materials and packaging therefor. In particular, some implementations of the present invention relate to systems and methods for packaging a thermoplastic material in a container having a quick opening mechanism that allows the container to easily be removed from the thermoplastic material and that allows the container to easily be knocked down or flattened.

In some non-limiting implementations, the present invention takes place in association with a container and a thermoplastic material. In this regard, the container can comprise virtually any suitable container that can easily be: (i) removed from the thermoplastic material and (ii) knocked down to be substantially flat. Some examples of such containers include a cardboard box, a corrugated polymer box, and/or any other suitable box.

As mentioned, in some implementations, the container comprises a quick opening mechanism that allows the container to easily be removed from the thermoplastic material and be flattened. Some examples of such mechanisms include, but are not limited to, one or more perforations in the container, tear strips, mechanical engagements (e.g., hook-and-loop fasteners, snaps, etc.), unraveling stitches (e.g., chain stitches), and/or other opening mechanisms that allow the container to perform its intended purposes. In some implementations, however, the opening mechanism comprises one or more perforations. In such implementations, the perforations can have any suitable characteristic. For instance, the perforations can: go partially or completely through a wall of the container; comprise a zipper perforation; comprise a staggered perforation in which one or more non-perforated portions of the container are disposed on a first end, a second, and/or within a perforated portion of the container; comprise a graduated or varied spacing between individual perforations to allow some portions of the container (or quick opening mechanism) to be stronger than others prior to opening, while still accommodating an easy tear; and/or have any other suitable feature.

While the quick opening mechanism can be disposed in any suitable location, in some implementations, it is disposed at a sidewall of the container so as to substantially extend between a first opening (e.g., a top opening) and a second opening (e.g., a bottom opening) of the container. Indeed, in some implementations, the quick opening mechanism is disposed at a corner of the container, between two of the containers sidewalls.

With respect to the liner, the liner can comprise any suitable material that can be disposed between an internal surface of the container and the thermoplastic material. In this regard, some examples of such materials, include, but are not limited to, one or more plastics, polymers (e.g., polypropylene, polyethylene, polypropylene/polyethylene blend, etc.), papers, etc. Additionally, the liner can comprise any suitable object, such as a bag, a wrapping, a molded/extruded object that is configured to hold the thermoplastic material, etc. In some cases, however, the liner comprises a bag, such as polyethylene bag.

The thermoplastic material can include any suitable type and grade of polymer-containing materials that change to a liquid or semi-liquid state when heated sufficiently, and that freeze or solidify to a rigid or semi-rigid state when cooled sufficiently. In this regard, some examples of such polymer-containing materials include, but are not limited to, one or more of the following: asphalts, asphalt cements, roofing asphalts, rubbers, thermoplastic elastomers, polybutadienes, styrene butadiene styrene block copolymers, styrene isobutyl butadiene copolymers, styrene ethylene butadiene styrene, polybenzimidazole, hydrogenated styrene butadiene styrene, styrene butadiene rubber, nitrile rubber, ethylene butadiene styrene, ethylene vinyl acetate, synthetic latex, latex, natural rubber, olefins, polyolefins, polyethylene, high density polyethylene, low density polyethylene, linear low density polyethylene, polypropylene, high density polypropylene, low density polypropylene, ethylene propylene copolymers, polystyrene, high density polystyrene, low density polystyrene, high impact polystyrene, polybutylene, polyisobutylene, polyvinyl chloride, polyurethane, polytetrafluoroethylene, light oils, vacuum gas oils, ground tire rubber, one or more oils, polymers, silicon, tar, and/or any other suitable materials exhibiting thermoplastic characteristics.

While the described systems and methods may be particularly useful in the areas of sealants (e.g., pavement crack sealants, joint sealants, and other sealants), waterproofing membranes, roofing asphalt, paving grade asphalt cement, and hot melt adhesives, those skilled in the art will appreciate that the described methods, processes, and materials can be used in a variety of different applications and in a variety of different areas of manufacture in which an easily openable and flattenable thermoplastic material packaging is desirable. Some non-limiting examples of such uses and applications include the use of the described packaged thermoplastic material for, or for use in association with, pavement maintenance (e.g., as asphalt crack sealants, concrete joint sealants, bridge deck membranes, bridge expansion joint sealants, wide crack sealants, pothole patching products, concrete spall repair products, concrete patching products, paving joint adhesives, traffic loop detector sealants, pavement marker adhesives, colored sealants and products, hot applied rubberized chip seal binders, chip seal binder additives, hot applied seal coats, etc.), roofing (e.g., as shingle tab adhesives, shingle lamination adhesives, waterproofing membranes, polymer roofing asphalt, polymer modified bitumen, blown roofing asphalt, planter box membranes, roofing seam adhesives, ice and snow shields, vertical surface adhesives, vertical surface repair, perforation repair, white hot applied waterproofing membranes and top coatings, silver hot applied waterproofing membranes and top coatings, gray hot applied waterproofing membranes and top coatings, etc.), paving (e.g., as paving grade asphalt cements, polymer modified paving asphalt cements, paving additives and modifiers, etc.), adhesives (e.g., as thermoplastic adhesive, packaging, construction materials, and/or any other suitable application), gaskets, thermoplastic paints, paints, thermoplastic sealants, silicon sealants, asphalt, sealants, caulking, hot melt or hot glue adhesives, extruded rubber products, pre-weighed polymers, and any other suitable process that allows for the use of a thermoplastic material comprising one or more recycled materials, such as eggshells, slag, recycled shingles, incinerator solid output, etc.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, at least one of which is illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to thermoplastic materials and packaging therefor. In particular, some implementations of the present invention relate to systems and methods for packaging a thermoplastic material in a container having a quick opening mechanism that allows the container to easily be removed from the thermoplastic material and that allows the container to easily be knocked down or flattened.

Figure 1:
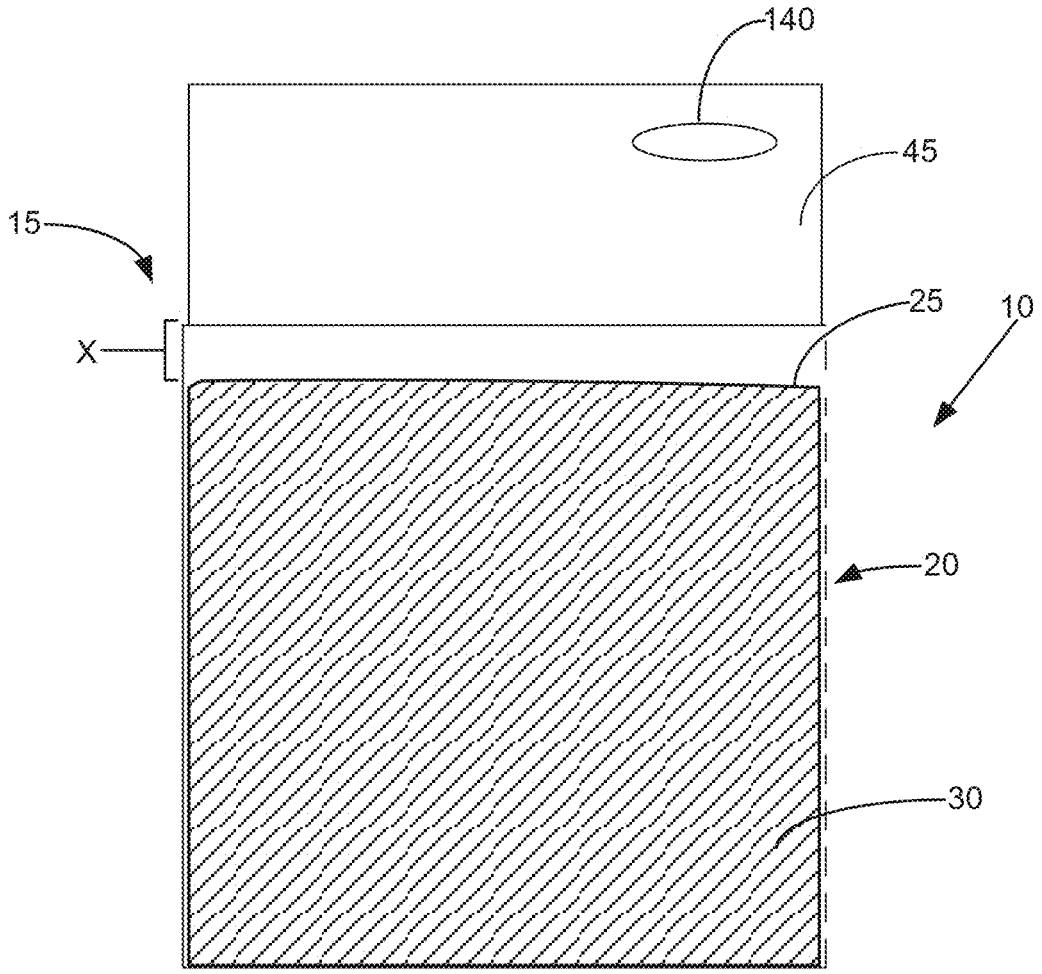
FIG. 1 illustrates a front elevation view of a representative embodiment of a container holding a thermoplastic material.

The described systems and methods can include the use of virtually any suitable component that allows a thermoplastic material to be packaged in a container that can, relatively easily, be: (a) removed from the thermoplastic material and (b) knocked down (or flattened). In this regard, FIG. 1 shows an embodiment in which the described thermoplastic packaging 10 comprises a container 15 having a quick opening mechanism 20, a liner 25, and a thermoplastic material 30.

With respect to the container 15, the container can comprise any suitable container that can house the thermoplastic material 30, be removed from the thermoplastic material (or have the thermoplastic material be removed from the container), and be flattened relatively easily. In this regard, some examples of suitable containers comprise a regular slotted container, a die-cut box (or a box that lacks a manufacturer's joint), a multiple-depth carton, a half-slotted carton (or a carton that has a set of flaps to close one end of the box, while the other end lacks flaps and can be open), a full overlap slotted carton, a five-panel folder style box, a snap-bottom carton, a full telescope design carton, a half telescope carton, a two-piece carton with a separate lid, a double cover carton, a one-piece folder, a tapeless box, a mailer-style box, a bin box, a bliss box, an eight-sided box, and/or any other suitable container.

Figure 2A:
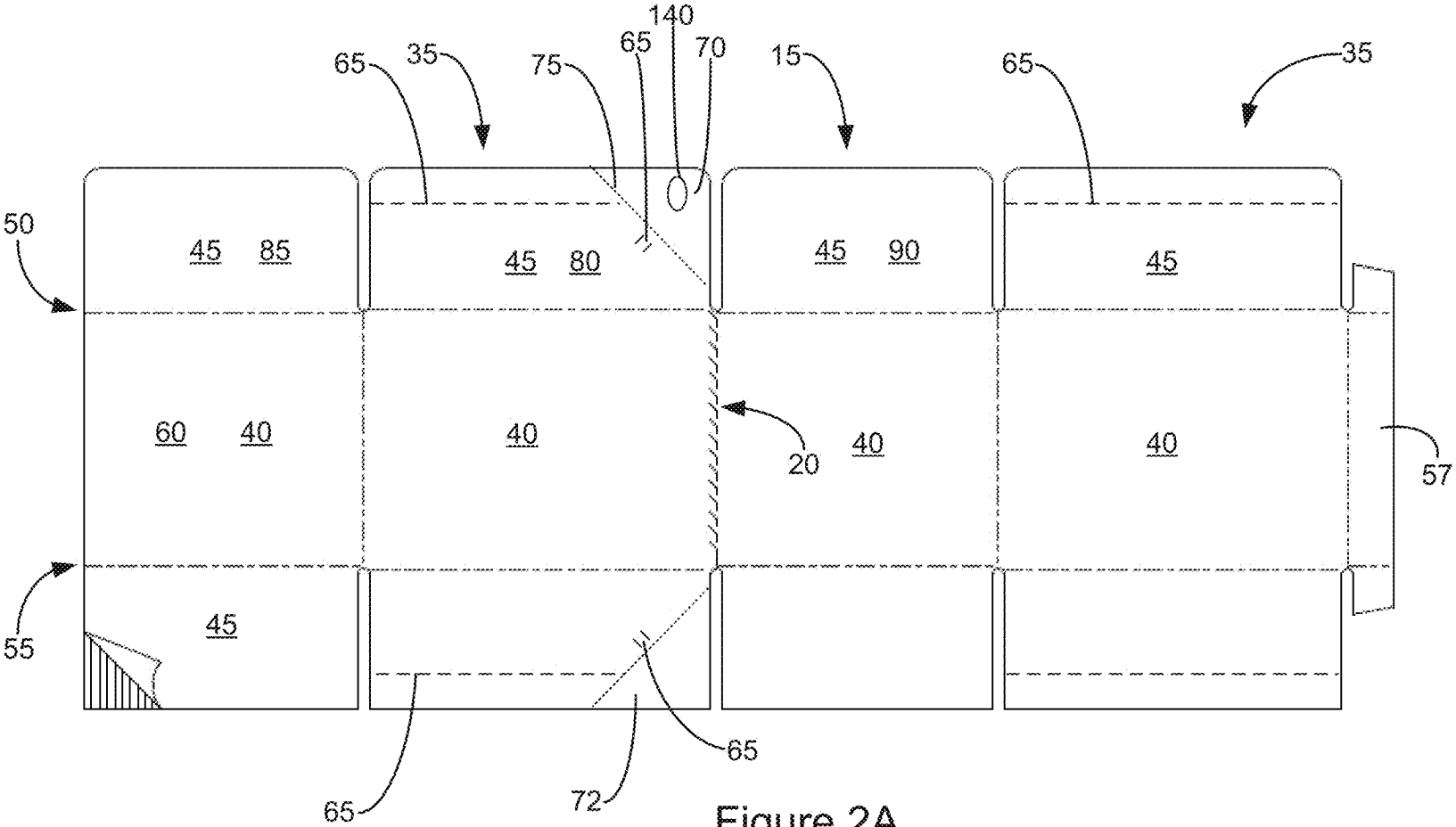
FIG. 2A illustrates a top plan view of a representative embodiment of the container prior to assembly.
Figure 2B:
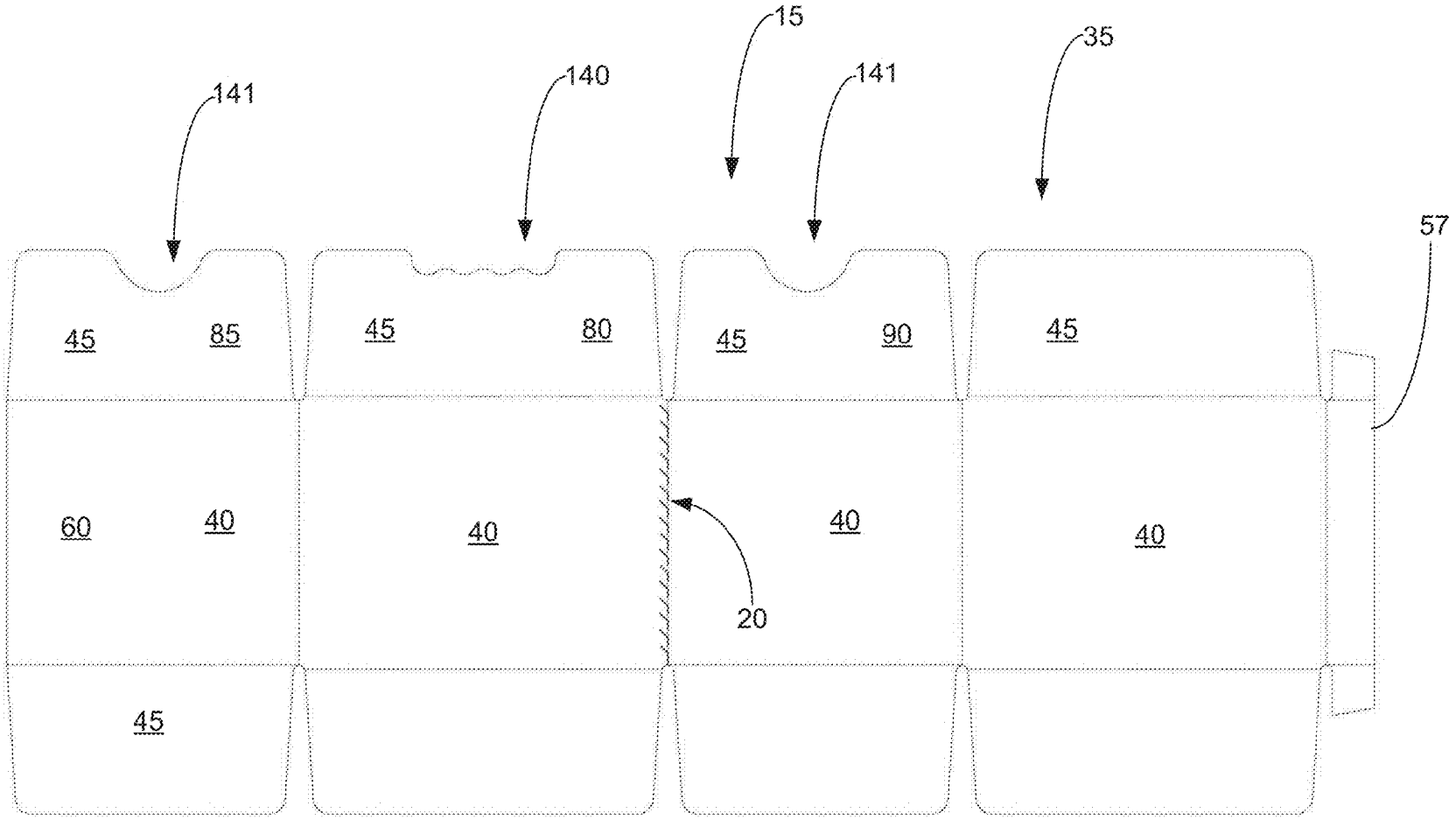
FIG. 2B illustrates a top plan view of a representative embodiment of the container prior to assembly

In accordance with some embodiments, FIGS. 2A and 2B show the container 15 comprises a slotted container 35. While such containers can comprise any suitable element that allows them to function as intended, FIGS. 2A and 2B show some embodiments in which the container 15 comprises one or more: sidewalls 40, flaps 45 that are configured to at least partially close a first 50 and/or second end 55 of the container, and/or tabs 57 to overlap with and attach to a portion of a first sidewall 60 to form a manufacturer's joint.

The container 15 can have any suitable shape that allows it to house the thermoplastic material 30, to be separated from the thermoplastic, and to readily be knocked down or flattened. Some examples of suitable shapes include, but are not limited to, a cube shape, a cuboidal shape, a cylindrical shape, a tubular shape, a polygonal prism shape (e.g., a triangular prism, a rectangular prism, a pentagonal prism, a hexagonal prism, an octagonal prism, etc.), a pyramidal shape, and/or any other suitable shape. Indeed, in some embodiments, the container 15 comprises a cube or cuboidal shape (e.g., as shown in FIG. 1 and FIGS. 4A-4C)) or an octagonal prism shape (not shown).

The container 15 can comprise any suitable material that allows it to function as intended. Some examples of suitable materials, include, cardboard, corrugated fiberboard, paperboard, boxboard, carton board, chipboard, Kraft board, laminated board, solid bleached board, solid unbleached board, containerboard, liner board, plastic, corrugated plastic, extruded polymer, (e.g., polypropylene resin and/or any other suitable polymer), a twin-walled plastic sheet product in which the walls are connected by flutes and/or any other suitable material. In some embodiments, however, the container comprises a corrugated cardboard and/or a corrugated plastic.

The walls of the container 15 can further comprise any suitable number or types of layers of material, including, without limitation, having 1, 2, 3, 4, 5, 6, 7, 8, or more layers. Indeed, in some embodiments, the container's walls (e.g., sidewalls 40, flaps 45, etc.) comprise a single ply material, a multi-ply material, a single wall, a double wall, a triple wall, a single face board, a single wall board, a double wall board, a triple wall board, and/or any other suitable number or types of layers. In some embodiments, however, the container's walls comprise a single wall cardboard (or one ply of fluted paper which is glued between two plies of paper).

The container 15 can be made in any suitable manner. Indeed, in some embodiments, the container is made by stamping out, cutting out, extruding, die cutting, punching out, molding, and/or otherwise forming a container (e.g., a knocked down box or a box that can readily be knocked down once the thermoplastic material 30 is separated from it). In some embodiments, the process of forming the container further comprises scoring, bending, folding, pressing, and/or otherwise manipulating the container to form a three-dimensional shape. In still other embodiments, one or more portions of the container are attached to each other to form and/or close at least a portion of the container. In this regard, the various portions (e.g., sidewalls 40, flaps 45, tabs 57, etc.) of the container can be attached to each other in any suitable manner, including, without limitation, via one or more adhesives (e.g., glues, cements, epoxies, pastes, etc.), tapes, mechanical fasteners (e.g., staples, brads, hook-and-loop fasteners, snaps, etc.), stitches, tab and slot connections, tongue and groove connections, frictional engagements, and/or other suitable attachment mechanisms. In some embodiments, however, one or more portions of the container (e.g., sidewalls, flaps, tabs, etc.) are attached to each other via an adhesive.

In some embodiments in which one or more portions of the container 15 are attached to each other to form the container into a three-dimensional shape, the various portions of the container (e.g., sidewalls 40, flaps 45, tabs 57, etc.) can be attached to each other in any suitable manner that allows the container to readily be knocked down once the container is removed from the thermoplastic material 30 (or vice versa). In some embodiments, however, the various portions of the container are attached to each other in such a manner that one or more of the joints (e.g., adhesive joints, hook and look joints, etc.) between the various portions are configured to be broken or otherwise separated from each other as the container is removed from thermoplastic (or vice versa).

In some such embodiments, one or more joints (e.g., glue spots, hook-and-loop connectors, snaps, etc.) are configured to separate as the container 15 is pulled from the thermoplastic 30 and the weight of the thermoplastic material (and/or force applied by a user) breaks the joints. While this can be accomplished in any suitable manner, in some embodiments, the container comprises less adhesive than some conventional boxes. In such embodiments, the adhesive can be applied to the container in any suitable manner, including, without limitation, in dots, dashed lines, irregular patterns, symmetrical patterns, and/or in any other suitable manner.

In some embodiments, the tensile strength of one or more joints of the container 15 is less than the ASTM International standards for a box holding a similar weight of a given thermoplastic material placed in the container. While the tensile strength of the joints can be any suitable amount less than the ASTM International standards for a comparable box containing a comparably sized and weighted object as the thermoplastic material, in some embodiments, the tensile strength of one or more joints of the container has a tensile strength that is between about 99% and about 1% of the ASTM International standard for such a container holding the thermoplastic material. Moreover, in some embodiments, one or more joints comprise a tensile strength that falls within any suitable sub-range of the foregoing range (e.g., between about 30% and about 85% (or between about 40% and about 65%) of the ASTM International standard for a similar box configured to hold one or more objects of a similar size and weight to the thermoplastic material.

In some embodiments, one or more portions (e.g., joints, sidewalls 40, flaps 45, etc.) of the container 15 optionally lack adhesive (or another connection mechanism) or have a weaker connection joint than do one or more other portions of the container. In this regard, the lack of joints or weakened joints can allow one or more portions of the container to easily be grabbed, and/or can allow the container to be knocked down relatively easily as the container is removed from the thermoplastic.

In one example in which one or more portions of the container 15 lack a joint or have a relatively weak joint, one or more corners of a flap 45 (e.g., corners that are located distally to a fold connecting the flap to a sidewall 40) lack a connection joint (e.g., an adhesive, a hook and loop connection, etc.) or have a weakened joint (e.g., a joint comprising less adhesive or a weaker adhesive than other joints in the container). By way of non-limiting illustration, FIG. 2A shows an embodiment in which one or more of the container's flaps 45 lacks adhesive 65 in a first 70 and/or second 72 distal corner (as illustrated by the dotted line 75) that is disposed adjacent to the quick opening mechanism 20 (which is discussed below). In this manner, the container is configured such that a user can easily grab a corner 70 of a first flap (e.g., flap 80) at a first end 50 or opening of the container, pull the first flap, break or otherwise separate one or more joints between the first flap (e.g., flap 80) and a second flap, a third flap, and/or another portion of the container (e.g., flaps 85 and/or 90), separate one or more sidewalls 40 via the quick opening mechanism 20, and/or break one or more joints at the second end 55 or opening of the container (e.g., between flaps 45 at the container's second 55 end) to knock down the container. Thus, in some embodiments, a user can simply remove the thermoplastic material 30 and knock down the container by pulling on a flap to rip the quick opening mechanism and allowing the weight of the thermoplastic material to further break the joints and knock down the container as the container is pulled away from the thermoplastic material.

In addition to the aforementioned characteristics, the container 15 can include any other suitable characteristic that allows it to fulfill its intended purposes. For instance, the container can comprise any suitable basis weight, surface treatment (e.g., cast-coated, pigment coated, uncoated, etc.), grade of material, main furnish (e.g., Z, C, N, T, D, etc.), color, bulk, pH, brightness, grammage, stiffness, smoothness, caliper/thickness, flute size (e.g., A, B, C, E, F, R, microflute, etc.), and/or other suitable characteristic.

In some instances, the container 15 optionally comprises one or more gripping surfaces that are placed in one or more strategic locations to allow for easy gripping of portions of the container, to make the opening process more obvious, and/or to otherwise simplify the opening of the container. In this regard, the container can comprise any suitable gripping surface that is configured to perform any of the above-mentioned purposes. Some examples of such gripping surfaces include, but are not limited to, one or more: preformed holes (e.g., holes that are configured to receive a hand or one or more fingers), perforated holes (e.g., perforated portions that can be bent, removed, or otherwise manipulated to form a hand or finger hole or hold), handles that are adhered or otherwise connected to the container, recesses in a perimeter of a portion of the container, and/or any other suitable handle or means for gripping the container. By way of non-limiting illustration, FIG. 1 shows an embodiment in which the container 15 comprises a precut handhold 140. Similarly, FIG. 2B illustrates an embodiment in which the container 15 comprises one or more recesses 141 that (in some embodiments) define a space for a user's hand (not shown) when the user grabs the handhold 140 to breakdown the container 15.

Where the container 15 comprises an optional gripping surface (e.g., a handhold 140), the gripping surface can be disposed in any suitable location that allows it to function as intended. Indeed, in some embodiments, the gripping surface (e.g., handhold 140) is disposed at (or defined in) one or more sidewalls 40, flaps 45, tabs 57, manufacture's joints, and/or any other suitable portion of the container. In accordance with some embodiments, however, FIG. 1 shows the gripping surface (namely handhold 140) is disposed adjacent to a corner of a flap 45, near the quick opening mechanism 20. Accordingly, in such embodiments, a user can easily grab the handhold and pull the handhold to and rip the container down the quick opening mechanism.

Figure 3A:
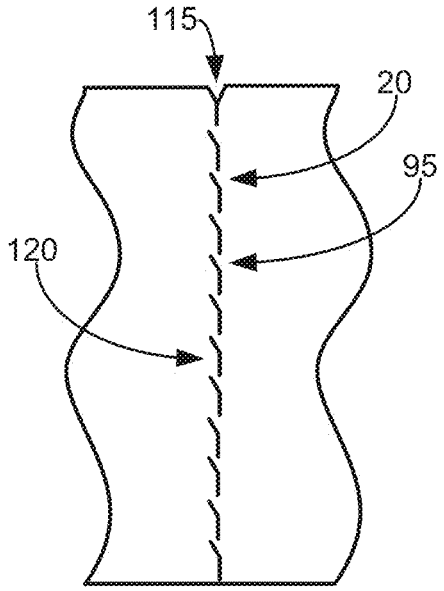
FIGS. 3A-3H illustrate elevation views of some representative embodiments of quick opening mechanisms.
Figure 3B:
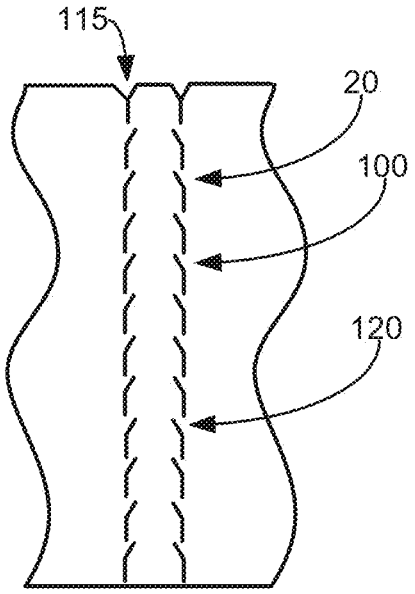
Figure 3C:
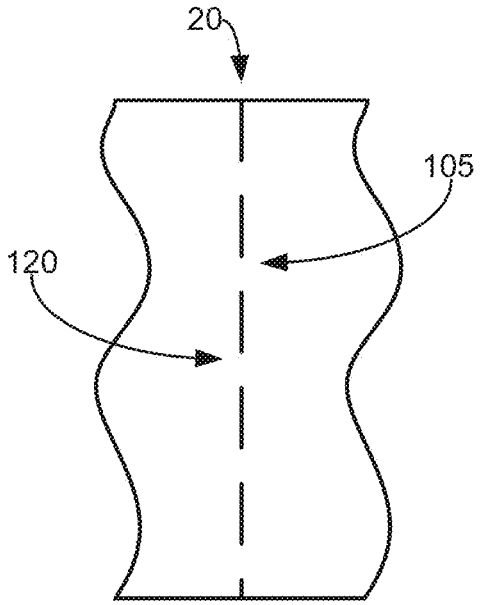
Figure 3D:
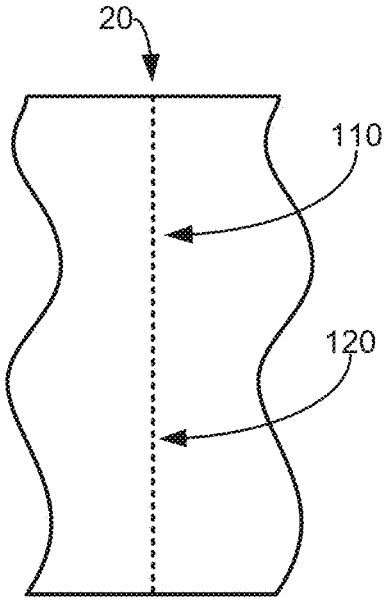
Figure 3E:
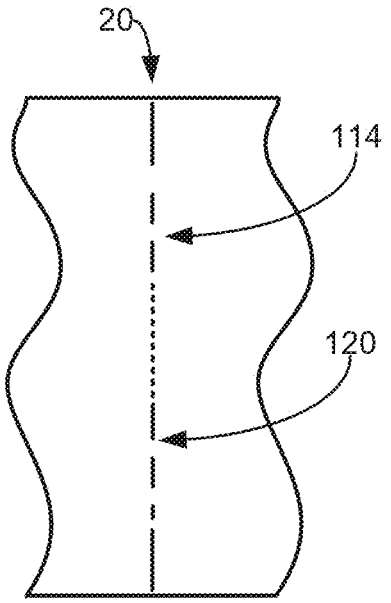
Figure 3F:
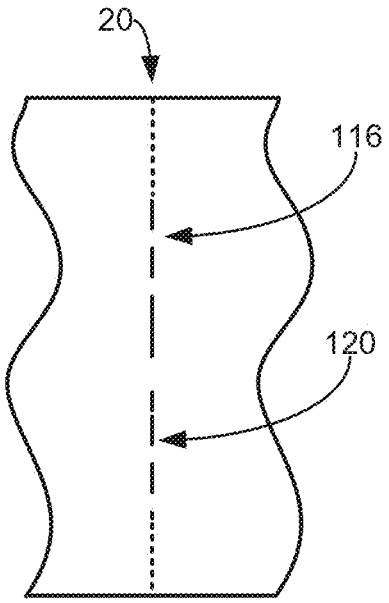
Figure 3G:
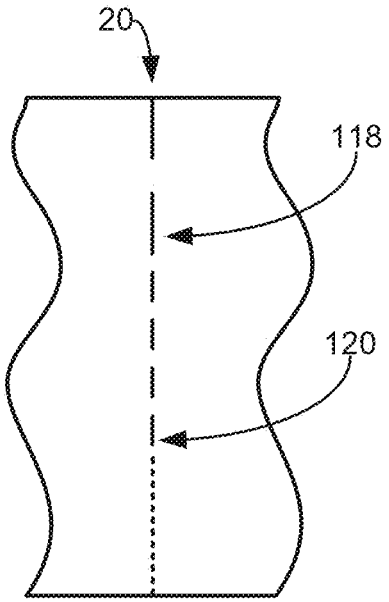
Figure 3H:
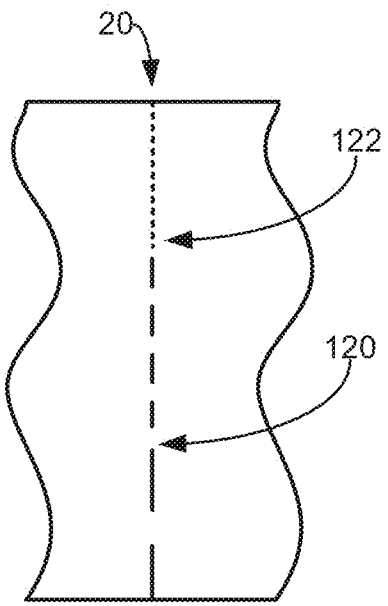
Figure 4A:
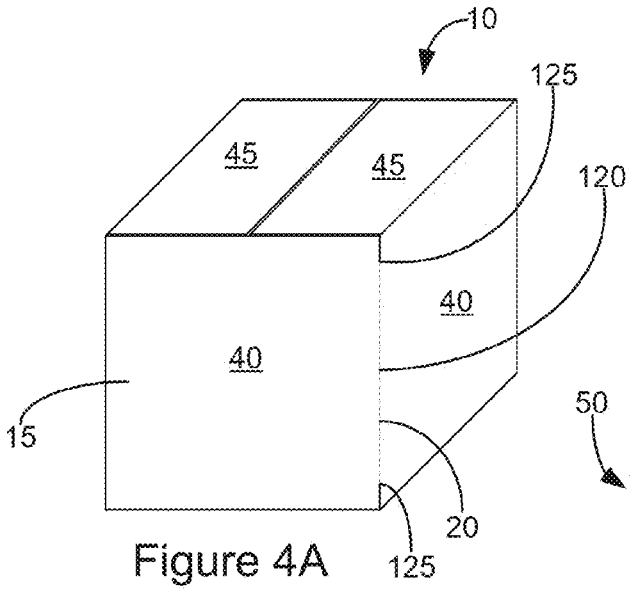
FIGS. 4A-4C each illustrates a perspective view of a different representative embodiment of the container holding the thermoplastic material.

Turning now to the quick opening mechanism 20, the thermoplastic packaging 10 can comprise any suitable quick opening mechanism that allows the container 15 to be removed relatively easily from the thermoplastic material 30 and to be flattened. Some examples of such mechanisms include, but are not limited to, one or more perforated portions of the container, scored portions of the container, tear strips (e.g., rip cords, pieces of tape or another adhesive with tear strip, etc.) hook and loop fasteners, types of stitching that are easily removed from the container (e.g., a locking chain stitch (such as can be found on some flour bags), a single thread chain stitch, a double thread chain stitch, and/or another stitch that connects two sidewalls or other pieces of the container together), a manufacturer's joint that is configured to separate relatively easily (e.g., a manufacturer's joint comprising a weakened joint, a hook and loop connection, etc.), and/or other mechanisms that are configured to allow the container to open at a wall (e.g., a sidewall 40, a corner between sidewalls, and/or any other suitable location). Indeed, in some preferred embodiments, the quick opening mechanism comprises a perforated portion of the container.

Where the quick opening mechanism 20 comprises a perforated portion of the container 15, the perforated portion can comprise any suitable type of perforation, including, without limitation, one or more push-and-tear perforations; lift-and-pull zippers; zipper pull perforations (e.g., a single zipper perforation 95, as shown in FIG. 3A; a double zipper perforation 100, as shown in FIG. 3B; etc.); dashed perforations (e.g., a dashed perforation 105, as shown in FIG. 3C); dot perforations (e.g., a dot perforation 110, as shown in FIG. 3D); press and lift perforations; rip tab perforations; perforations that extend through all layers of a sidewall; perforations that extend through only a portion of the layers of a container wall; graduated or varied perforations (e.g., portions in which the spacing between individual perforations increases or decreases in length or is otherwise varied to allow some areas of the quick opening mechanism to be stronger prior to opening. but to still accommodate an easy tear, some examples of graduated perforations 114, 116, 118, and 122 are shown in FIGS. 3E-3H); and/or any other suitable type of perforation. In some embodiments, however, the perforation comprises a single zipper perforation. Accordingly, in some embodiments, when a user pulls the container on one side of the quick opening mechanism, the single zipper perforation separates and allows the container to be readily removed from thermoplastic material 30.

Where the quick opening mechanism 20 comprises one or more perforated portions in the container 10, the quick opening mechanism can have any suitable characteristic that allows the container to function as intended. In one example, FIG. 3A shows that, in at least some embodiments, the quick opening mechanism 20 comprises a notch, groove, or other starting point 115 that is configured to channel tearing forces to the perforation 120. In another example, the quick opening mechanism 20 comprises a non-perforated section 125 flanking one or both ends (or disposed between both ends) of a perforated section 120 (e.g., as shown in FIG. 4A). While such a non-perforated section can perform a variety of functions, in some embodiments, it helps prevent the quick opening mechanism from opening until a user intends to tear the container at the mechanism.

In another example of a suitable characteristic of perforations in the opening mechanism 20, in some embodiments, the perforations in the opening mechanism are evenly spaced with respect to each other. In still another example, however, one or more perforations in the opening mechanism are staggered and/or unevenly spaced. In yet another example, the perforations in the opening mechanism can comprise any suitable portion of the mechanism that allows the container to function as intended. Indeed, in some embodiments, the perforations (e.g., holes in the opening mechanism) comprise any suitable portion of the length of the opening mechanism, including, without limitation, between about 5% and about 99% of the length of the mechanism (or the distance between two ends (e.g., 50 and 55) or openable portions of the container), or any sub-range thereof (e.g., between about 30% and about 85%).

Figure 4B:
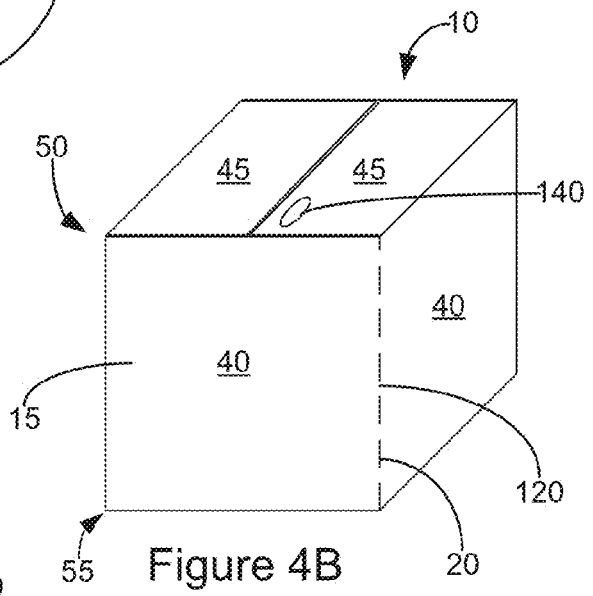
Figure 4C:
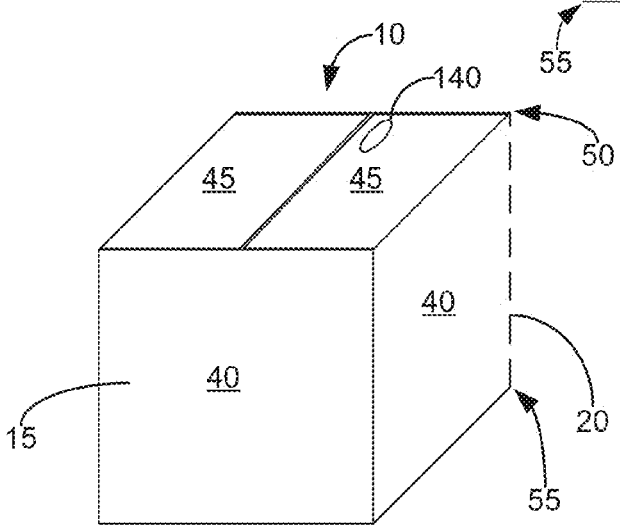
Figure 5:
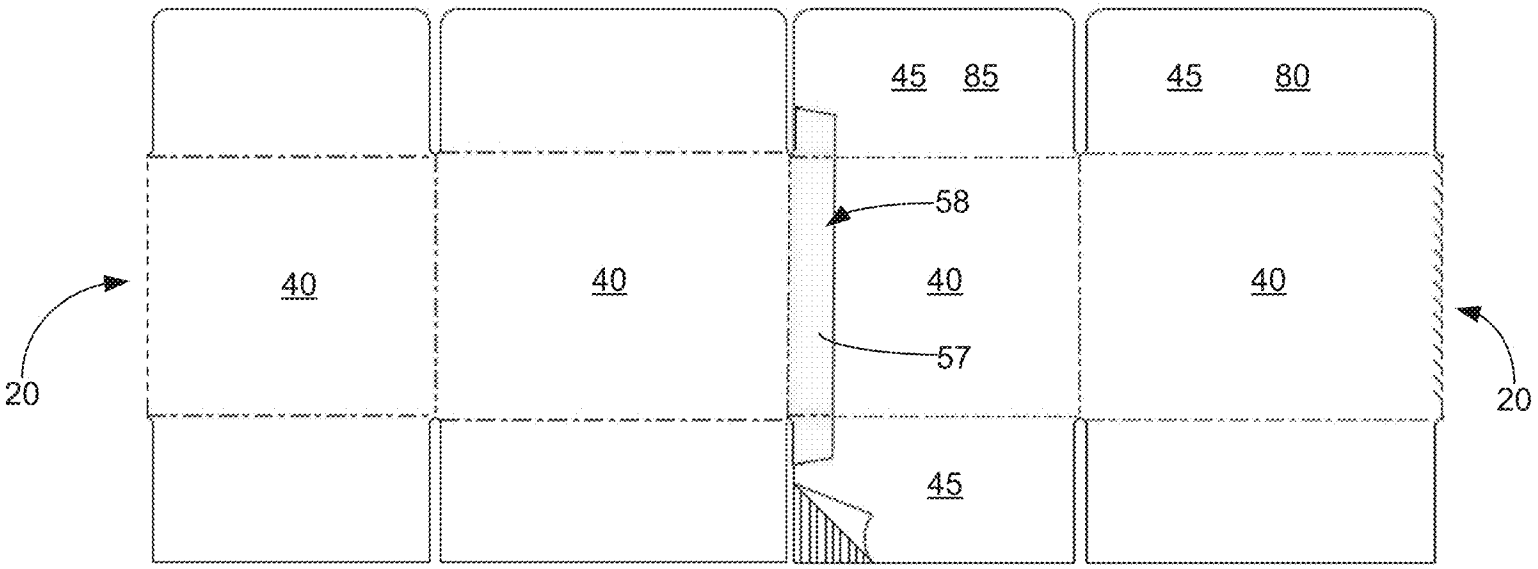
FIG. 5 illustrates a top plan view of a representative embodiment of the container once the quick opening mechanism has been opened and the container has been knocked down.

The quick opening mechanism 20 can be disposed in any suitable location that allows a user to open the mechanism and separate a portion of the container 15 to remove the container from the thermoplastic material 30. Indeed, in accordance with some embodiments, FIGS. 4B and 4C show the quick opening mechanism 20 is located between one or more sidewalls 40 of the container 15 (e.g., at or near a corner of two sidewalls, at the manufacturer's joint 58 (see FIG. 5), between a sidewall and a flap 45, etc.). FIGS. 4B and 4C further show that, in some embodiments, the quick opening mechanism 20 extends or substantially extends between a first end 50 or openable portion and a second end 55 or openable portion of the container 15. Accordingly, FIG. 5 shows that, in some embodiments, as the quick opening mechanism 20 is separated between two ends (e.g., ends 50 and 55) of the container 15 and the joints between the flaps 45 are separated (e.g., broken by the weight of the thermoplastic material and/or force of the user), the container is knocked down—thus, allowing multiple knocked down containers to be neatly stacked for easily disposal and for maintenance of a clean working area.

Figure 6A:
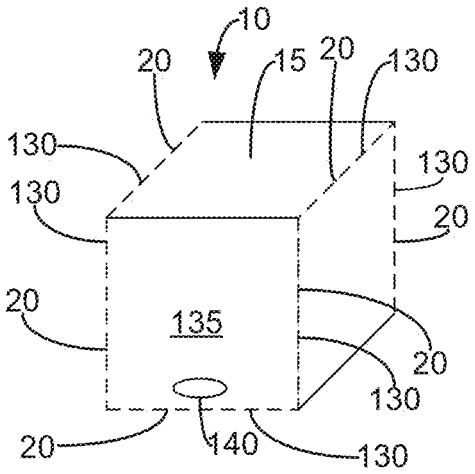
FIG. 6A illustrates a perspective view of a representative embodiment of the container.
Figure 6B:
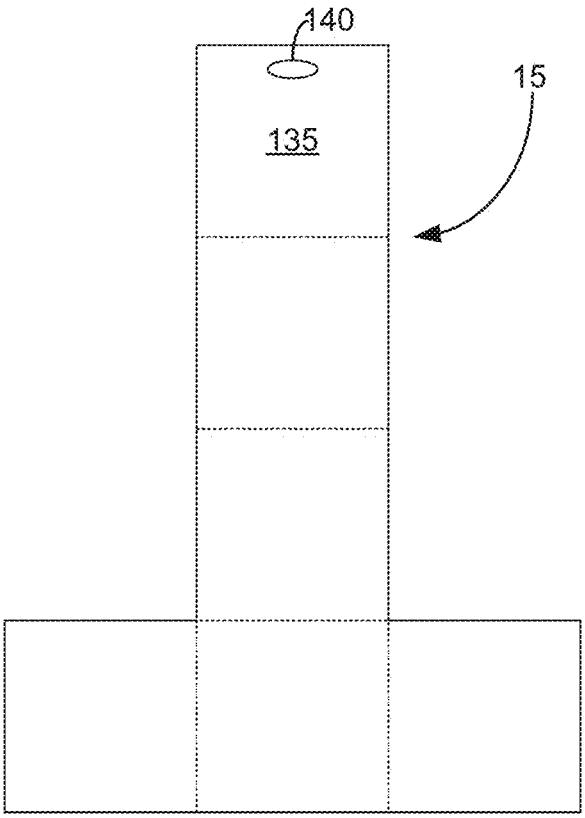
FIG. 6B illustrates a top plan view of a representative embodiment of the container of FIG. 6A, wherein the container has been knocked down.

In still other embodiments (not shown), the opening mechanism 20 is disposed in a single sidewall of the container (e.g., in embodiments in which the container comprises a cylindrical sidewall). In yet other embodiments, while FIGS. 4C and 5 show some embodiments in which the opening mechanism 20 runs substantially perpendicular to a plane of the first end 50 and a plane of a second end of the container 15, in some cases, the opening mechanism runs diagonally, in a zig-zag pattern, and/or in any other suitable manner between two portions of the container (e.g., between the first end 50 and the second end 55). Additionally, while FIGS. 4C and 5 show some embodiments in which the container 15 comprises a single opening mechanism 20 disposed between two side walls 40, in some embodiments, the container comprises more than one opening mechanism and/or the opening mechanism is disposed between more than two sidewalls or other portions of the container. In this regard, the opening mechanism can be disposed between any suitable number and combination of portions of the container. Indeed, by way of non-limiting illustration, FIG. 6A shows an embodiment in which 6 or 7 edges 130 of the container 15 comprise a quick opening mechanism 20. Thus, FIG. 6B shows that when a user pulls on a first portion 135 of the container 15, the container opens along its opening mechanism 20 to knock down the container (e.g., into a T-shaped object, though a wide variety of other embodiments and shapes are also possible).

With reference now to the liner 25, the liner can comprise any suitable component or characteristic that allows the thermoplastic material 30 to be stored in and removed from the container. Indeed, in some embodiments, the liner is configured to allow relatively little to none of the thermoplastic material to stick to the container—thus, allowing the container to be removed from the thermoplastic material and/or be recycled more readily than if it were bound to or otherwise covered with the thermoplastic. In some embodiments, the liner comprises a material that is coated on an internal surface of the container. In other embodiments, however, the liner comprises a bag, sack, wrapping, molded material, encapsulation, and/or other material that is configured to cover at least a portion of the thermoplastic material. Moreover, while some embodiments of the liner are configured to be removed from the thermoplastic, in other embodiments, the liner is configured to be melted and/or mixed with the thermoplastic material to become part of a thermoplastic product.

The liner 25 can comprise any suitable material that allows it to fulfill its intended purposes. In this regard, some examples of such materials, include, but are not limited to, one or more plastics, polymers (e.g., polypropylene, polyethylene, polypropylene/polyethylene blend, etc.), papers, etc. In some embodiments, however, the liner comprises a polymer material, such as polyethylene bag.

With reference to the thermoplastic material 30, the material can be used to form any suitable thermoplastic product. Some non-limiting examples of such products include sealants (e.g., pavement crack sealants, joint sealants, wide crack sealants, pavement joint sealants, asphalt sealants, concrete sealants, bridge expansion joint sealants, colored sealants, and other sealants), waterproofing membranes, paving grade asphalt cement, hot melt adhesives, pavement maintenance materials (e.g., bridge deck membranes, pothole patching products, concrete spall repair products, concrete patching products, paving joint adhesives, pavement marker adhesives, colored products, hot applied rubberized chip seal binders, chip seal binder additives, hot applied seal coats, etc.), roofing (e.g., roofing asphalts, shingle tab adhesives, shingle lamination adhesives, waterproofing membranes, polymer roofing asphalts, polymer modified bitumens, blown roofing asphalts, rolled roofing seam adhesives, ice and snow shields, vertical surface adhesives, vertical surface repairs, perforation repairs, white hot applied waterproofing membranes and top coatings, sliver hot applied waterproofing membranes and top coatings, gray hot applied waterproofing membranes and top coatings, etc.), paving materials (e.g., paving grade asphalt cements, polymer modified paving asphalt cements, paving additives and modifiers, etc.), adhesives (e.g., thermoplastic adhesives for crafts, packaging, construction, and/or any other suitable application), planter box membranes, gaskets, thermoplastic paints, paints, asphalt sealants, cement sealants, caulking, extruded rubber products, preweighed polymers, and virtually any other suitable product containing a thermoplastic material and one or more recycled materials (e.g., eggshell, recycled asphalt shingles, recycled asphalt pavement, slag, incinerator solid output, and/or one or more other recycled materials). In some embodiments, however, the thermoplastic product comprises a sealant.

With respect to the thermoplastic material, the thermoplastic material can comprise virtually any suitable thermoplastic (or combination of thermoplastics) that is capable of being part of the thermoplastic packaging 10. In this regard, some non-limiting examples of suitable thermoplastic materials include any suitable type and grade of one or more: asphalts, asphalt cements, roofing asphalts, rubbers, thermoplastic elastomers, polybutadienes, styrene butadiene styrene block copolymers, styrene isobutyl butadiene copolymers, styrene ethylene butadiene styrene, polybenzimidazole, hydrogenated styrene butadiene styrene, styrene butadiene rubber, nitrile rubber, ethylene butadiene styrene, ethylene vinyl acetate, synthetic latex, latex, natural rubber, olefins, polyolefins, polyethylene, high density polyethylene, low density polyethylene, linear low density polyethylene, polypropylene, high density polypropylene, low density polypropylene, ethylene propylene copolymer, polystyrene, high density polystyrene, low density polystyrene, high impact polystyrene, polybutylene, polyisobutylene, polyvinyl chloride, polyurethane, polytetrafluoroethylene, light oils, vacuum gas oils, ground tire rubber, one or more oils, polymers, silicon, tar, Trinidad lake asphalt, Great Salt Lake oil, polymer materials, and/or any other material or materials exhibiting thermoplastic characteristics (either alone or when mixed with other materials). In some embodiments, however, the thermoplastic material comprises a known or novel asphalt.

In addition to including one or more thermoplastic materials, the described thermoplastic products can comprise any other suitable ingredient or ingredients that allow the thermoplastic products to be used for one or more of the aforementioned applications. In this regard, some non-limiting examples of other suitable ingredients that can be included in the thermoplastic product include perlite microspheres, ceramic microspheres, talc, glass, cement, kaolin, limestone, sodium bentonite, sulfur, mineral fillers, aggregates, fibers, tar sands, plasticizers, anti-strip agents, polyester fibers, light weight aggregates, calcium oxide, magnesium oxide, titanium dioxide, aluminum (e.g., aluminum metal flake), graphite, carbon, iron oxide, iron sulfide, iron carbonate, recycled Portland cement, zeolite, diatomite, sepiolite, calcium bentonite, quartz, diatomaceous earth, any other suitable materials, recycled materials (e.g., incinerator solid output, eggshell, ground tire material, linear low density polyethylene, ethylene polypropylene copolymer, SPS material, SPR material, wax product, etc., and/or any suitable combination thereof. In some non-limiting embodiments, the recycled materials are used in place of a portion (if not all) of the limestone or other filler that is used in a conventional or novel thermoplastic product.

The various ingredients of the described thermoplastic material 30 can be present in the product at any suitable concentration. In one non-limiting example, Table 1 shows some representative weight percentage ranges of some ingredients for inclusion into various thermoplastic materials of the present invention. As used in this example and throughout this specification, the term raw material, and variations thereof, may refer to various ingredients of a thermoplastic material before such ingredients are heated with other ingredients to form a liquid or semi-liquid phase of the thermoplastic material.

TABLE 1

| Raw Material | Weight % Range |
|---|---|
| Asphalt Cement | 0-99.9% |
| Light Oils | 0-95% |
| Styrene Butadiene Styrene Block Copolymers | 0-20% |
| Styrene Butadiene Rubber | 0-20% |
| Polyolefins | 0-99.9% |
| Ground Tire Rubber | 0-50% |
| Ground Limestone | 0-70% |
| Ground Talc | 0-70% |
| Ground Sodium Bentonite | 0-15% |
| Anti-Strip Agents | 0-2% |
| Plasticizers | 0-5% |
| Roofing Asphalt | 0-99.9% |
| Tar Sands | 0-99.9% |
| Trinidad Lake Asphalt | 0-99.9% |
| Great Salt Lake Oil | 0-70% |
| Polyester Fiber | 0-30% |
| Light Weight Aggregates (specific gravity 1.0 to 2.0 g/ml) | 0-80% |
| Medium Light Weight Aggregates (specific gravity 2.0 to 3.0 g/ml) | 0-80% |
| Perlite microspheres | 0-80% |
| Calcium Oxide | 0-70% |
| Magnesium Oxide | 0-70% |
| Titanium dioxide | 0-80% |
| Aluminum Metal Flake | 0-90% |
| Carbon black | 0-50% |
| Polystyrene | 0-20% |
| Iron Oxide | 0-95% |
| Iron Carbonate | 0-95% |
| Iron Sulfide | 0-95% |

TABLE 1-continued

| Raw Material | Weight % Range |
|---|---|
| Asphalt Shingles | 0-70% |
| Eggshells | 0-70% |
| Iron | 0-70% |
| Steel | 0-70% |
| Slag from Mineral Refining | 0-95% |
| Slag from Iron and Steel Manufacturing | 0-95% |
| Slag from Iron and Steel Recycling | 0-95% |
| Recycled Portland Cement | 0-95% |

Those skilled in the art will appreciate that the raw materials and corresponding formula percentage ranges are representative only. Accordingly, some embodiments of the present invention embrace the addition of other raw materials and/or other percentage ranges (including, without limitation, sub-ranges of the ranges in Table 1), particularly for roofing asphalt, asphalt cement, waterproofing membranes, and hot melt adhesives, as well as sealants which contain fiber and aggregate or no asphalt at all.

In another non-limiting example, Table 2 provides representative weight percentage ranges of ingredients for inclusion into some embodiments of the described thermoplastic materials:

TABLE 2

| Raw Material | Weight % Range |
|---|---|
| Asphalt Cement | 49%-77% |
| Light Oils | 0%-23% |
| Styrene butadiene Styrene block copolymers | 0%-6% |
| Styrene butadiene Rubber | 0%-4% |
| Polyolefins | 0%-3% |
| Ground Tire Rubber | 0%-22% |
| Ground Limestone | 0%-34% |
| Recycled Material (e.g., eggshell, asphalt shingles, slag, tar paper, asphalt pavement, ethylene polypropylene copolymer, etc.) | 0%-51% |
| Ground Talc | 0%-8% |
| Ground Sodium Bentonite | 0%-9% |
| Anti-Strip Agents | 0%-1% |
| Plasticizers | 0%-1% |

Those skilled in the art will appreciate that the raw materials and corresponding formula percentage ranges are representative only. Accordingly, embodiments of the present invention embrace the addition of other raw materials and/or other percentage ranges (including sub-ranges of the ranges in Table 2).

With reference to the recycled material (e.g., eggshells, incinerator solid output, recycled shingles, etc.), the recycled material can optionally be included in the thermoplastic material 30 at any suitable concentration. Indeed, in some embodiments, the recycled material comprises between about 0.01% and about 95%, by weight, of the described thermoplastic material. In other embodiments, the recycled material comprises between about 1% and about 70%, by weight, of the thermoplastic material. In still other embodiments, the recycled material comprises between about 5% and about 50%, by weight, of the thermoplastic material. In still other embodiments, the recycled material comprises between about 10% and about 35%, by weight, of the thermoplastic material. In yet other embodiments, the recycled material comprises any suitable sub-range of any of the aforementioned ranges. Indeed, in some embodiments, the recycled material comprises between about 8% and about 30%, by weight, of the thermoplastic material.

The thermoplastic material 30 contained in the container 15 can be any suitable weight and density that allows the container to function as intended. Indeed, as mentioned above, in some embodiments, the weight of the thermoplastic material helps to break joints and flatten the container. In one example of a suitable weight, the thermoplastic in the container weighs between about 200 grams and about 100 kilograms. In another example, the weight of thermoplastic in the container falls within any suitable sub-range of the aforementioned range (e.g., between about 1 kilogram and about 25 kilograms, between about 2 kilograms and about 15 kilograms, etc.).

Additionally, FIG. 1 shows that in some embodiments in which the thermoplastic material 30 is disposed within the container 15, there is a space X between the top of the thermoplastic material and an end of the container (e.g., the first end 50 of the container). While this space can serve any suitable function, in some embodiments, it allows a user to depress a portion of a flap (e.g., flap 80) to grab the flap and open the quick opening mechanism 20. Although the space X between the top of the thermoplastic material and an end of the container can be any suitable distance, in some embodiments, it is between about 2 millimeters and about 50 centimeters, or any sub-range thereof (e.g., between about 1 and about 5 centimeters).

The described thermoplastic packaging 10 can be made in any suitable manner. By way of non-limiting example, while the method for creating the packaging can be rearranged, shortened, added to, and otherwise modified in any suitable manner, in some embodiments, the methods include providing a container 15 with a quick opening mechanism 20, forming the container into a three-dimensional shape (e.g., a box), placing a thermoplastic material 30 (e.g., with or without a liner 25) in the container, and closing the container (e.g., via an adhesive) in a manner that the process of opening the container and removing the container from the thermoplastic or vice versa allows one or more joints in the container to separate and that allows the container to become substantially flat.

The described systems, methods, and products can be varied in any suitable manner that allows for the production of packaging for a thermoplastic material 30, wherein the packing is easily removed from the thermoplastic and flattened. Indeed, in some non-limiting embodiments, the container comprises a reusable material (e.g., a corrugated polymer and/or another suitable material) and the quick opening mechanism comprises a reusable and/or replaceable mechanism (e.g., a hook and loop fastener, a piece of tape or another adhesive with tear strip, etc.). As a result, in some such embodiments, the container can readily be reused.

In addition to the aforementioned features, the described thermoplastic packaging can have one or more additional features. In one non-limiting example, some embodiments of the container are removable from a thermoplastic 30 and flattenable, relatively easily. As a result, such systems and methods allow the container to save time, be relatively easy to stack and dispose of, and to otherwise be easy to use.

Thus, as discussed herein, the present invention relates to thermoplastic materials and packaging therefor. More particularly, some embodiments of the invention relate to systems and methods for packaging a thermoplastic material in a container having a quick opening mechanism that allows the container to easily be removed from the thermoplastic material and that allows the container to easily be knocked down or flattened.

The present invention may be embodied in other specific forms without departing from its spirit or essential characteristics. The described embodiments and examples are all to be considered, in all respects, only as illustrative and not as being restrictive in any manner. The scope of the invention is, therefore, indicated by the appended claims rather than by the foregoing description. All changes that come within the meaning and range of equivalency of the claims are to be embraced within their scope.

What is claimed is:

1. A packaged thermoplastic material, comprising:

a container; and a thermoplastic material that is disposed in the container, the thermoplastic material comprising at least one of:

(i) a thermoplastic paving sealant, (ii) a thermoplastic crack sealant, (iii) a thermoplastic joint sealant, (iv) a thermoplastic bitumen, (v) a roofing sealant, (vi) an asphalt, and (vii) a tar; and wherein the container comprises a quick opening mechanism disposed along a bent edge of the container so as to substantially extend along a full length of the bent edge, wherein the container comprises a recessed handhold that is disposed adjacent to the quick opening mechanism, wherein the container comprises a first sidewall and a second sidewall, wherein the bent edge comprising the quick opening mechanism is disposed between the first sidewall and the second sidewall, wherein the recessed handhold is defined in at least one of: (i) the first sidewall and (ii) a first foldable flap extending from the first sidewall, and wherein the quick opening mechanism is configured to readily open and allow the container to be opened at the quick opening mechanism.

2. The packaged thermoplastic material of claim 1, wherein the container comprises the first foldable flap, wherein the first foldable flap extends from the first sidewall at a first end of the container, and wherein the recessed handhold is defined in the first foldable flap.

3. The packaged thermoplastic material of claim 2, wherein the container further comprises a second foldable flap that extends from the second sidewall at the first end of the container, and wherein the second foldable flap defines a first recess.

4. The packaged thermoplastic material of claim 1, wherein the quick opening mechanism is configured to split the container between the first sidewall and the second sidewall while allowing the container to comprise a single object comprising substantially the entire container.

5. The packaged thermoplastic material of claim 1, wherein the quick opening mechanism comprises a chain stitch.

6. The packaged thermoplastic material of claim 1, wherein the container comprises a plastic container and wherein the quick opening mechanism comprises at least one of a hook-and-loop fastener and mechanical engagement.

7. The packaged thermoplastic material of claim 3, wherein the container further comprises a third sidewall, wherein the first sidewall is disposed between the second sidewall and the third sidewall, wherein a third foldable flap extends from the third sidewall, and wherein a perimeter of the third foldable flap defines a second recess.

8. A thermoplastic package comprising:

a box comprising a first sidewall, a second sidewall, a first end, a second end that is disposed substantially opposite to the first end, a first bent edge disposed between the first sidewall and the second sidewall, and a first foldable flap that extends from the first sidewall at the first end of the box;

a thermoplastic material disposed within the box, the thermoplastic material comprising at least one of a: (i) a thermoplastic paving sealant, (ii) a thermoplastic crack sealant, (iii) a thermoplastic joint sealant, (iv) a thermoplastic bitumen, (v) a roofing sealant, (vi) an asphalt, and (vii) a tar, wherein the first bent edge comprises a quick opening mechanism that substantially extends between the first end and the second end of the box, and wherein the first foldable flap defines a recessed handhold.

9. The package of claim 8, wherein the box further comprises a second foldable flap that extends from the second sidewall and at the first end of the box, and wherein the second foldable flap defines a first recess that is configured to substantially correspond in position with a position of the recessed handhold of the first foldable flap when the first and second foldable flaps are folded down to close a portion of the first end of the boxer.

10. The package of claim 8, wherein the recessed handhold is defined in a perimeter of the first foldable flap.

11. The package of claim 8, wherein the recessed handhold is defined within the first foldable flap.

12. The package of claim 9, wherein the box further comprises a third sidewall, wherein the first sidewall is disposed between the second sidewall and the third sidewall, wherein a third foldable flap extends from the third sidewall, and wherein a perimeter of the third foldable flap defines a second recess that is configured to substantially correspond in position with the position of the recessed handhold of the first foldable flap when the first and third foldable flaps are folded down to at least partially close the first end of the box.

13. A method for packaging a thermoplastic material, the method comprising:

obtaining a box comprising a first sidewall, a second sidewall, a first end, a second end that is disposed substantially opposite to the first end, a bent edge disposed between the first sidewall and the second sidewall, and a first foldable flap that extends from the first sidewall at the first end of the box, wherein the first bent edge comprises a quick opening mechanism that substantially extends between the first end and the second end of the box, and wherein the first foldable flap defines a recessed handhold;

placing a thermoplastic material in the box, the thermoplastic material comprising at least one of a: (i) a thermoplastic paving sealant, (ii) a thermoplastic crack sealant, (iii) a thermoplastic joint sealant, (iv) a thermoplastic bitumen, (v) a roofing sealant, (vi) an asphalt, and (vii) a tar; and closing the box such that the box is configured to be knocked down as the quick opening mechanism is opened and the box is separated from the thermoplastic material.

14. The method of claim 13, wherein the box further comprises a second foldable flap that extends from the second sidewall, at the first end of the box, and wherein a perimeter of the second foldable flap defines a first recess.

15. The method of claim 14, wherein the box further comprises a third sidewall, wherein the first sidewall is disposed between the second sidewall and the third sidewall, wherein a third foldable flap extends from the third sidewall at the first end of the box, and wherein a perimeter of the third foldable flap defines a second recess.

16. The method of claim 15, wherein the closing of the box further comprises folding the first, second, and third flaps down, such that the first recess and the second recess substantially correspond in position to the recessed handhold.

17. The method of claim 15, wherein the quick opening mechanism comprises a perforated section, wherein the box comprises cardboard, and wherein the thermoplastic comprises a thermoplastic sealant.

18. The packaged thermoplastic material of claim 7, wherein the first recess and the second recess are configured to substantially correspond to a position of the recessed handhold when the first, second, and third foldable flaps are folded to at least partially close the first end of the container.

19. The package of claim 8, wherein the recessed handhold is defined in the first sidewall.

* * * * *